US008664549B2

(12) United States Patent
Grumel et al.

(10) Patent No.: US 8,664,549 B2
(45) Date of Patent: Mar. 4, 2014

(54) SWITCHGEAR DEVICE HAVING SEVERAL SINGLE-POLE SWITCHING UNITS AND COMPRISING A SINGLE ACTUATING MECHANISM OF SAID UNITS

(75) Inventors: Christophe Grumel, Lans en Vercors (FR); Denis Giraud, Grenoble (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 136 days.

(21) Appl. No.: 13/309,191

(22) Filed: Dec. 1, 2011

(65) Prior Publication Data

US 2012/0145520 A1 Jun. 14, 2012

(30) Foreign Application Priority Data

Dec. 13, 2010 (FR) ..... 10 04834

(51) Int. Cl.
*H01H 9/00* (2006.01)
*H01H 19/62* (2006.01)
*H01H 27/00* (2006.01)

(52) U.S. Cl.
USPC ..... 200/17 R

(58) Field of Classification Search
USPC .... 200/17 R, 18, 5 R, 5 B, 5 C, 19.01–19.03, 200/19.06, 19.07, 19.18, 19.19, 19.22, 200/19.27, 19.3, 49, 51.06, 50.34, 553, 558, 200/329, 339
See application file for complete search history.

(56) References Cited

U.S. PATENT DOCUMENTS

| | | | | |
|---|---|---|---|---|
| 5,357,066 | A | 10/1994 | Morel et al. | |
| 6,194,983 | B1 * | 2/2001 | Bogdon et al. | 335/68 |
| 6,870,112 | B2 * | 3/2005 | Bresciani et al. | 200/244 |
| 7,750,259 | B2 * | 7/2010 | Besana et al. | 200/244 |
| 7,800,007 | B2 * | 9/2010 | Soundararajan et al. | 200/400 |
| 2003/0098224 | A1 | 5/2003 | Castonguay et al. | |
| 2007/0075047 | A1 | 4/2007 | Oh | |
| 2007/0075808 | A1 | 4/2007 | Ahn | |

FOREIGN PATENT DOCUMENTS

| | | | |
|---|---|---|---|
| EP | 0 540 431 | A1 | 5/1993 |
| EP | 2 148 351 | A2 | 1/2010 |
| FR | 2 891 661 | A1 | 4/2007 |

* cited by examiner

*Primary Examiner* — Edwin A. Leon
*Assistant Examiner* — Anthony R. Jimenez
(74) *Attorney, Agent, or Firm* — Steptoe & Johnson LLP

(57) ABSTRACT

A switchgear device including a main unit supporting an operating mechanism, and at least one auxiliary unit, wherein the units each includes a rotary bar mounted in a mobile contact bridge for rotation around an axis of rotation, and two stationary contacts are connected with the mobile contact bridge. The operating mechanism moves a drive rod through an angular path which results in moving all of the mobile contact bridges between an open position and a closed position. A stop, against which the drive rod presses in the closed position, limits movement of the drive rod, and applies a rotational torque to the drive rod to keep it parallel to the axis of rotation.

8 Claims, 4 Drawing Sheets

SWITCHGEAR DEVICE HAVING SEVERAL SINGLE-POLE SWITCHING UNITS AND COMPRISING A SINGLE ACTUATING MECHANISM OF SAID UNITS

BACKGROUND OF THE INVENTION

The invention relates to a switchgear device comprising a single-pole main switching unit supporting an operating mechanism and at least a first single-pole auxiliary switching unit, said units being arranged side by side in a transverse direction. Each switching unit comprises a rotary bar coupled to a mobile contact bridge guided in rotation around an axis of rotation. Two stationary contacts collaborate with the mobile contact bridge and are respectively connected to a current input conductor. The operating mechanism of the switching units comprises a handle commanding at least one drive rod passing through the bars, an angular movement of said at least one drive rod driving that of the mobile contact bridge between an open position and a closed position of the contacts.

STATE OF THE ART

The use of the single operating mechanism able to act on several switching units is known. Generally, the operating mechanism is designed to operate with multipole switchgear devices such as in particular three-pole or four-pole devices.

When the operating mechanism is associated with operation of a three-pole switchgear device, a symmetric positioning of the mechanism with respect to the three switching units positioned side by side is observed. Transmission of the operating forces Fc is then distributed uniformly between all the contact poles. The pressure force Fp and contact over-travel force measured at the level of each contact pole are appreciably constant.

Two-pole or three-pole circuit breakers present the drawback of inducing a dissymmetry in the distribution of the poles with respect to the centralized position of the operating mechanism. This dissymmetry is particularly detrimental for compound switchgear cartridge products comprising a contact support bar. By construction, a link part of the operating mechanism connects all the contact support bars to one another. The link part is generally composed of at least one drive rod. Said drive rod then undergoes large mechanical stresses due to the combined effect of the contact pressure forces Fp, Fc and of the operating mechanism.

In practice, as represented in FIG. 6A, in the case of a two-pole or three-pole circuit breaker, the dissymmetry induces a swivelling which results in disconnection of the pole the farthest away from the operating mechanism. Depending on the country in which the circuit breaker is installed, the pole the farthest away can be the neutral or a phase. This disconnection of the pole results in a loss of depression and of contact pressure Fp at the level of said pole. Concomitantly, an overload of the pole adjacent to the mechanism and opposite the above-mentioned pole is observed. This overload results in a too large depression and contact pressure.

To solve this problem of imbalance observed in the forces applied at the level of the contacts, certain solutions describe the use of an additional mechanism. Indeed, as described in Patent application EP0540431, the switchgear cartridge or unit that is eccentric with respect to the operating mechanism comprises an auxiliary mechanism comprising spring means. Coupling means connect the main operating mechanism to the auxiliary mechanism. These solutions present the drawback of using additional operating means which further create slowing-down of the movable contact on opening. This slowing-down eventually results in faster wear of the contact. These additional operating means can also take the place of one or more auxiliaries.

Other solutions as described in Patent application US2007/0075808 use a link part between all the switching units comprising two drive rods. The use of two drive rods enables a certain rigidity of the parts to be obtained thereby reducing mechanical deformations. However, although it reduces the problems related to the geometric imbalance described above, this solution is not completely satisfactory.

Finally, the solution described in Patent application US2003/0098224 comprises an operating mechanism specifically dedicated to a three-pole switchgear device. The operating mechanism is then positioned on two switching units placed in the centre. This solution presents the drawback of having a specific operating mechanism per operating device. The operating device associated with a four-pole circuit breaker cannot for example be used for a three-pole circuit breaker and vice-versa.

SUMMARY OF THE INVENTION

The object of the invention is therefore to remedy the drawbacks of the state of the art so as to propose a switchgear device comprising an efficient operating mechanism of the switching units.

The switchgear device according to the invention comprises compensation means comprising a stop against which the drive rod comes and presses in the closed position so as to locally limit movement of said drive rod at the level of the first auxiliary unit and to apply a rotational torque to said rod to keep the latter parallel to the axis of rotation.

According to a mode of development of the invention, said at least first auxiliary switching unit comprises a case comprising an aperture in the form of an arc of a circle in which the drive rod moves between the closed and open positions, the stop being positioned such as to reduce the length of the arc of a circle and the angular movement of said rod in said aperture.

According to a first particular embodiment, the stop is positioned in the first single-pole switching unit at one end of the arc of a circle forming the aperture so as to reduce the travel of the drive rod moving inside the aperture.

According to a second particular embodiment, the stop is positioned on an external flange-plate of the switchgear device, said flange-plate being positioned against an outer wall of the first single-pole switching unit.

The switchgear device according to the invention preferably comprises three single-pole auxiliary switching units arranged side by side in a transverse direction, the first auxiliary switching unit being separated from the other two auxiliary switching units by the main switching unit supporting the operating mechanism of said units.

Advantageously, the stop is rigid with adjustable height.

Advantageously, the stop comprises a deformable means.

Advantageously, the stop comprises a spring.

BRIEF DESCRIPTION OF THE DRAWINGS

Other advantages and features will become more clearly apparent from the following description of a particular embodiment of the invention, given for non-restrictive example purposes and represented in the appended drawings in which.

DETAILED DESCRIPTION OF AN EMBODIMENT

The switchgear device 600 comprises a main switching unit Bp supporting an operating mechanism and at least a first auxiliary switching unit Ba1.

Figure 1:
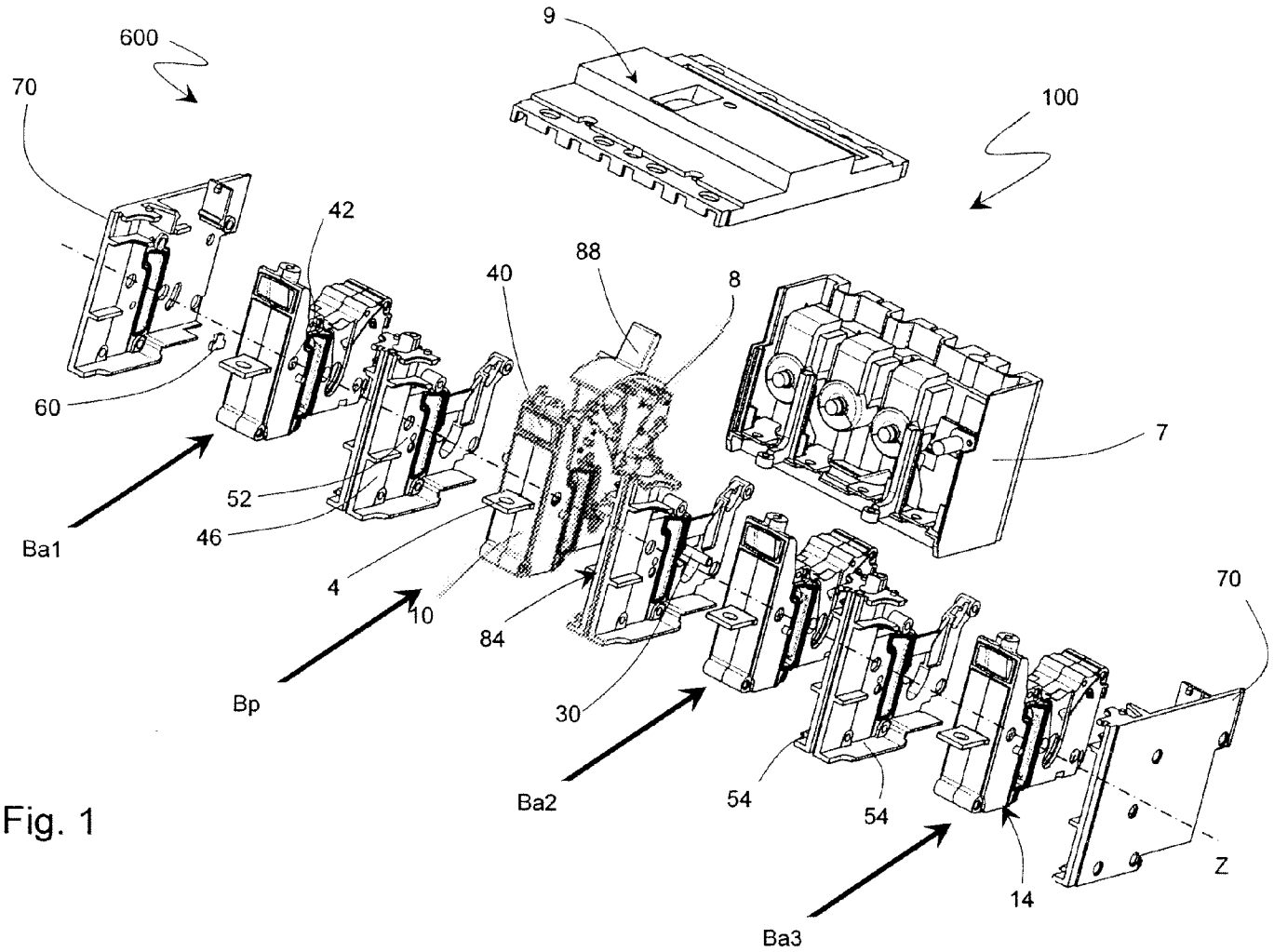
FIG. 1 represents an exploded perspective view of a circuit breaker comprising a switchgear device according to an embodiment of the invention.

According to a preferred embodiment of the invention as represented FIG. 1, the switchgear device 600 comprises four single-pole switching units Bp, Ba1, Ba2, Ba3 arranged side by side in a transverse direction. Said device in particular comprises three auxiliary switching units Ba1, Ba2, Ba3. The first auxiliary switching unit Ba1 is separated from the other two auxiliary switching units Ba2, Ba3, the main switching unit Bp supporting the operating mechanism 8 of said units. The switchgear apparatus 100, generally a circuit breaker, is then a four-pole circuit breaker.

As an example embodiment, the switchgear apparatus 100 comprises a trip unit 7 associated with the switchgear device 600. The single-pole switching units are then designed to be respectively connected both to the trip unit 7 at the level of the load-side connecting strip 5 and to a current line to be protected at the level of a line-side connecting strip 4. The single-pole switching unit 10 is also called cartridge.

For the sake of simplification of presentation of a preferred embodiment of the invention, the element composing the switchgear apparatus 100, and in particular the single-pole switching units Bp, Ba1, Ba2, Ba3 forming the switchgear device 600, will be described in relation with the position of use in which the circuit breaker 100 is fitted in a panel, with the nose 9 comprising a vertical handle 88 parallel to the mounting wall, the line-side connecting strips 4 on the electric line located at the top and forming the top surface 74 of the switchgear device 100 and the trip unit 7 at the bottom. The use of the relative position terms such as "lateral", "top", "bottom" etc. should not be interpreted as a limiting factor. The handle is designed to command an actuating mechanism 8 of the electric contacts.

Each single-pole switching unit Bp, Ba1, Ba2, Ba3 enables a single pole to be broken. Said unit is advantageously in the form of a flat enclosure 12 made from moulded plastic, with two parallel large sides 14 separated by a thickness e. In particular, in the illustrated embodiment, the thickness e is about 23 mm for a 160 A rating.

The enclosure 12 is made up of two parts, preferably in symmetric fashion, secured to one another on their large side 14 by any suitable means. As illustrated in a preferred embodiment in FIG. 5, a complementary system of tenon/mortar type enables the parts of the enclosure 12 to be fitted to one another, one of the two parts (not shown) comprising suitable pins to enter recesses 16 of the other part. Arrangements 18 are furthermore provided to enable juxtaposition of the enclosures 12 of single-pole unit Bp, Ba1, Ba2, Ba3 and to secure the latter by means of a multipole circuit breaker 100.

Each single-pole switching unit comprises a breaking mechanism 20 housed in the enclosure 12. According to a particular embodiment illustrated in FIGS. 4 and 5, the breaking mechanism 20 is preferably of rotary double breaking type. The switchgear apparatus 100 according to the invention is in fact particularly designed for applications up to 630 A and in certain applications up to 800 A, for which single breaking may not be sufficient.

The breaking mechanism 20 comprises a mobile contact bridge 22 rotating around an axis of rotation Z. The mobile contact bridge 22 is mounted floating in a rotary bar 26 having a transverse opening for housing said contact bridge. Said bridge is salient on each side of the bar 26. Said rotary bar 26 is inserted between the two lateral panels 14 of the enclosure 12 of the switching unit Bp, Ba1, Ba2, Ba3.

The mobile contact bridge 22 comprises a contact strip at each end. The switching unit comprises a pair of stationary contacts 41, 51. Each stationary contact is designed to collaborate with a contact strip of the mobile contact bridge 22. A first stationary contact 41 is designed to be connected to the current line by a line-side connecting strip 4. The second stationary contact 51 is designed to be connected to the trip unit 7 by a load-side connecting strip 5. Each part of the enclosure 12 comprises a corresponding passage recess.

Said bridge is mounted swivelling between an open position in which the contact strips are separated from the stationary contacts 41, 51 and a closed position in which they are in contact with each of the stationary contacts. The contact strips of the contact bridge 22 are preferably placed symmetrically with respect to the axis of rotation Z.

Figure 4:
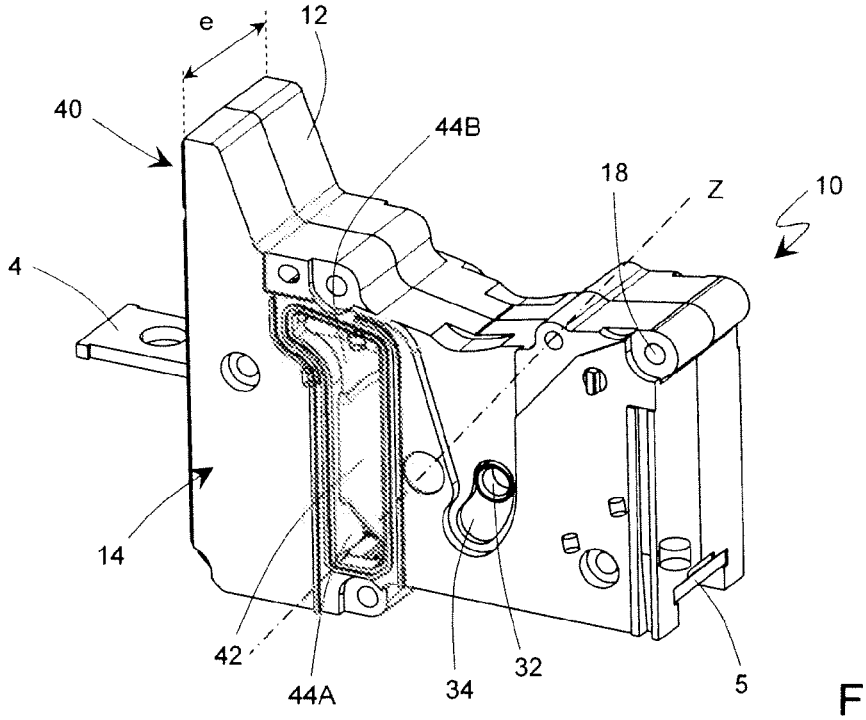
FIGS. 4 and 5 show perspective views of a single-pole switching unit of a switchgear device according to an embodiment of the invention.
Figure 5:
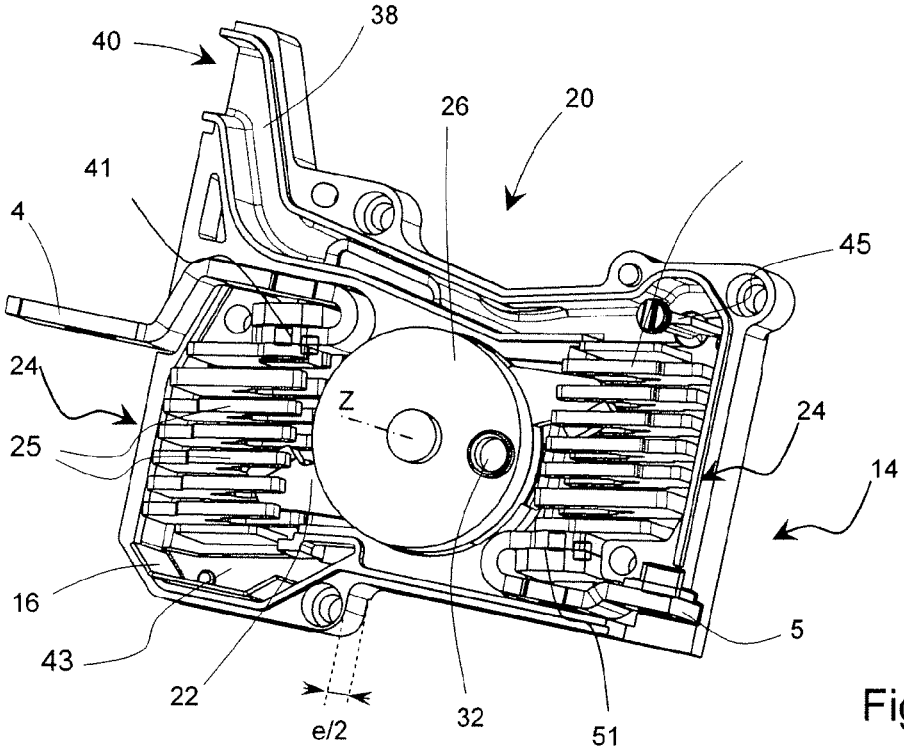

The single-pole switching units Bp, Ba1, Ba2, Ba3 preferably comprise two arc extinguishing chambers 24 for extinguishing electric arcs. Each arc extinguishing chamber 24 is located in an open volume between a contact strip of the contact bridge 22 and a stationary contact. Each arc extinguishing chamber 24 is delineated by two side walls 24A, a rear wall located away from the opening volume 24B, a bottom wall 24C close to the stationary contact and a top wall 24D. As represented in FIGS. 4 to 6, each arc extinguishing chamber 24 comprises a stack of at least two deionization fins 25 separated from one another by an exchange space of the breaking gases. Each arc extinguishing chamber 24 comprises at least one outlet connected to at least one exhaust channel 38, 42 of the breaking gases.

The single-pole switching units Bp, Ba1, Ba2, Ba3 are designed to be driven simultaneously and are coupled for this purpose by at least one drive rod 30. As represented in the figures, the drive rod 30 comprises a longitudinal axis Y substantially parallel to the axis of rotation Z of the mobile contact bridge.

Figure 6A:
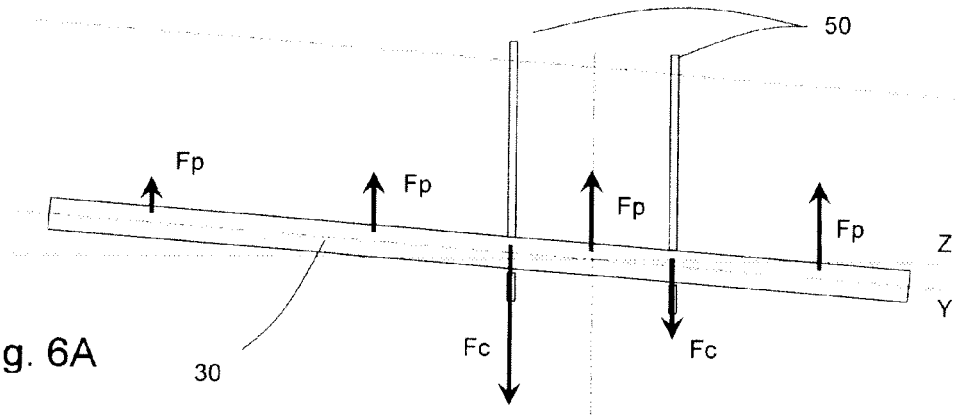
FIG. 6A represents a schematic view of the distribution of the contact pressure forces of a switchgear device of known type.
Figure 6B:
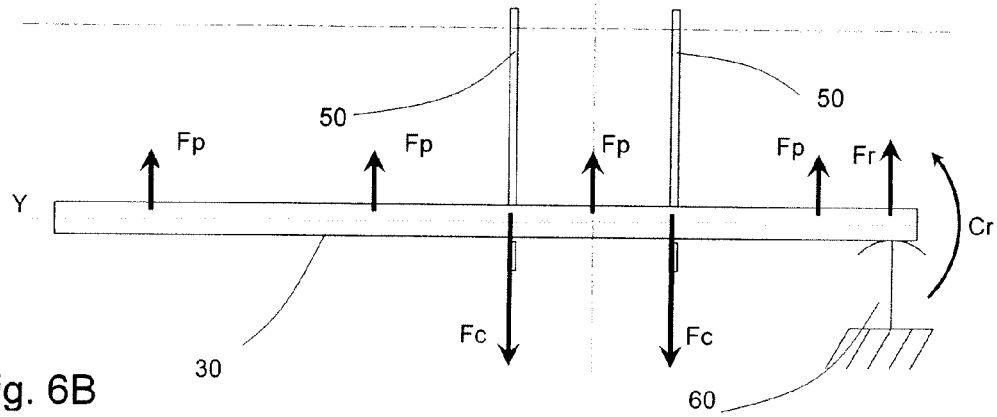
FIG. 6B represents a schematic view of the distribution of the contact pressure forces of a switchgear device according to the invention.

A switching unit operating mechanism 8 is positioned on the main switching unit Bp. The operating mechanism 8 comprises a handle 88 controlling movement of the drive rod 30 via connecting rods 50. As represented in FIGS. 6A, 6B, said connecting rods transmit a control force Ft on drive rod 30.

The drive rod 30 passes through the bars 26 of the switching units Bp, Ba1, Ba2, Ba3 via apertures 32.

According to a preferred embodiment, a single drive rod 30 is used.

An angular movement of said drive rod 30 drives that of the mobile contact bridge 22 between an open position and a closed position of the contacts.

Each part of the enclosure 12 comprises an aperture 34 in the form of an arc of a circle enabling at least movement of the drive rod 30 passing through the latter between the current flow position and the open position. Advantageously, each part of the enclosure 12 is moulded with internal arrangements enabling a relatively stable positioning of the different elements composing the breaking mechanism 20, in particular two symmetric housings for each of the arc extinguishing chambers 24, and a circular central housing enabling the bar 26 to be fitted.

According to a preferred embodiment, the switchgear device 600 comprises compensation means of movement of the drive rod 30. The compensation means comprise a stop 60 against which the drive rod 30 comes and presses in the closed position.

Figure 7:
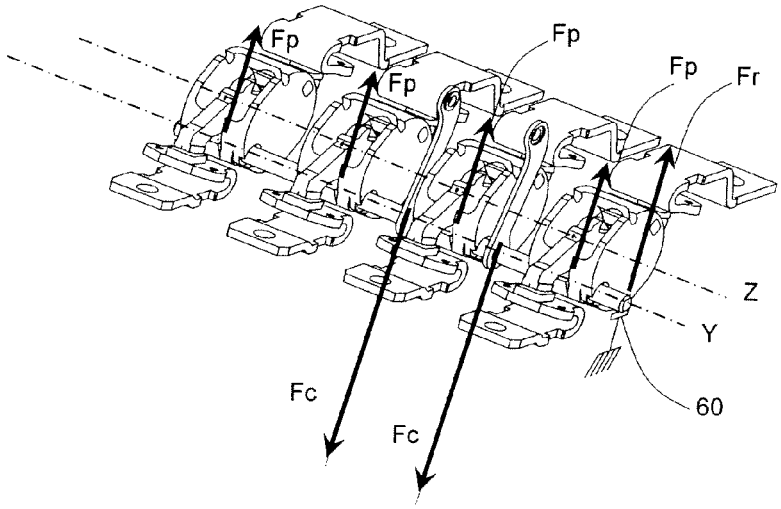
FIG. 7 represents a perspective view of the switching units of a switchgear device according to the invention.

Positioning of the stop 60 is performed such as to locally limit movement of said drive rod 30 at the level of the first auxiliary switching unit Ba1. As represented in FIG. 6B, the stop tends to apply a compensation force Fr designed to generate a rotational torque Cr on the drive rod 30 so that the longitudinal axis Y of said rod does not pivot at the end of movement and in particular when a mobile contact bridge 22 is in a closed position of the contacts. Thus, unlike known solutions and as represented in FIGS. 6B and 7, the longitudinal axis Y of the drive rod 30 is kept parallel to the axis of rotation Z of the rotary bar.

Figure 2:
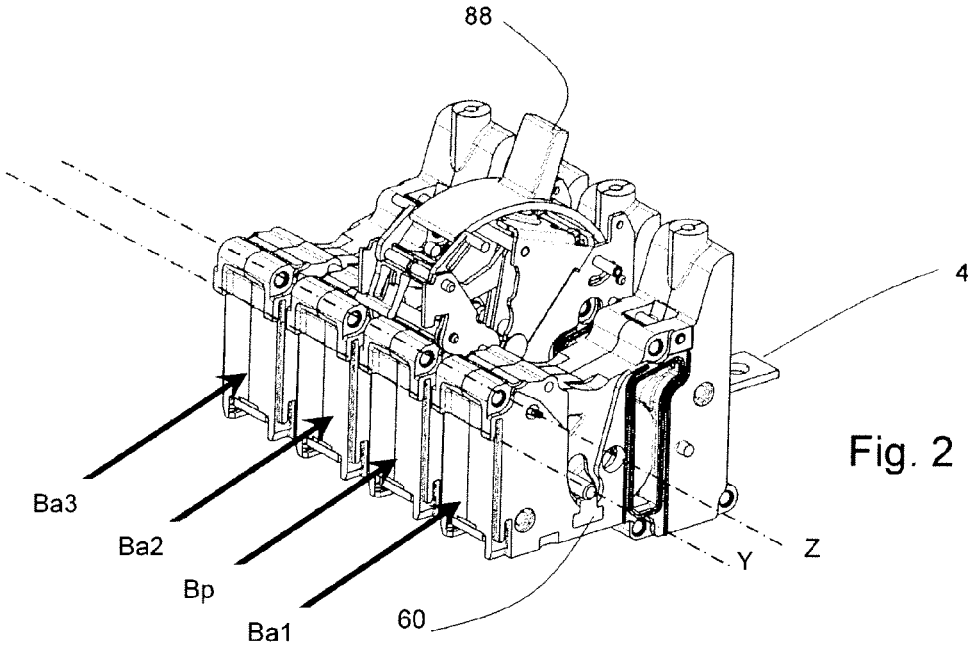
FIG. 2 represents a perspective view of a switchgear device according to FIG. 1.
Figure 3:
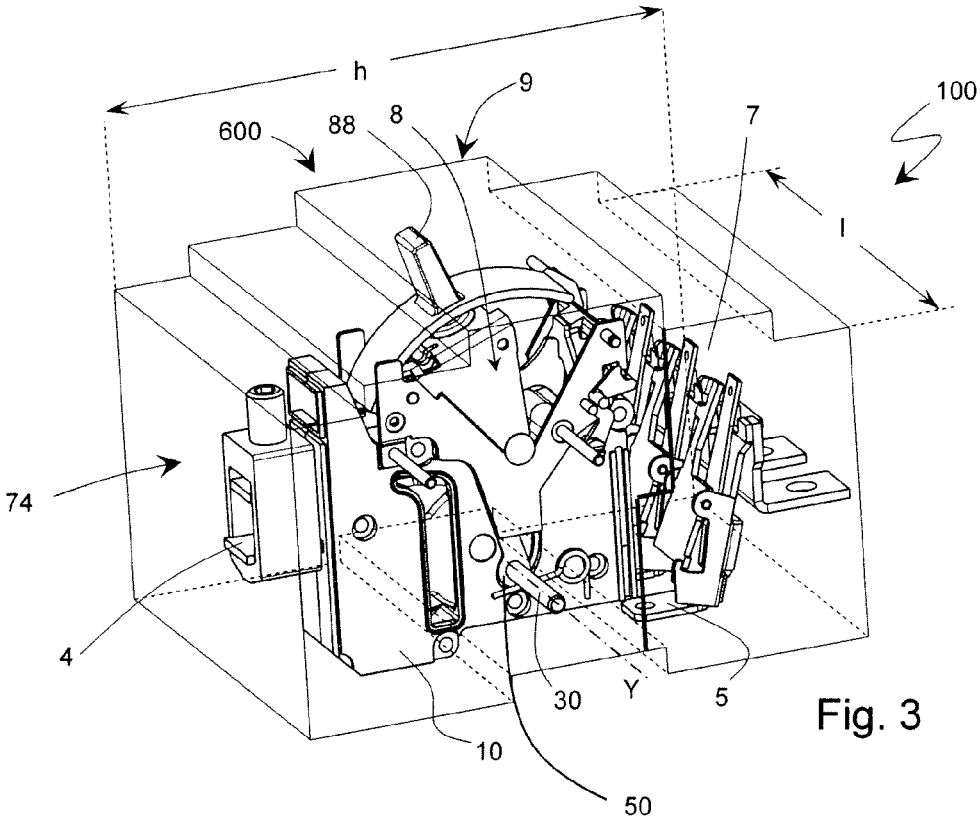
FIG. 3 represents a perspective overview of a circuit breaker according to an embodiment of the invention.

According to a first particular embodiment of the invention as represented in FIG. 2, the stop 60 is preferably positioned at one end of the arc of the circle forming the aperture 34 so as to reduce the length of the arc of the circle and the angular movement of said rod. According to this particular embodiment, the stop 60 is positioned in the first auxiliary switching unit Ba1. In other words, positioning of the stop inside the aperture 34 enables the travel of the drive rod 30 moving inside said aperture to be reduced.

According to another particular embodiment that is not represented, the stop 60 is positioned on an external flange-plate 70 of the switchgear device, said flange-plate 70 being positioned against an outer wall of the enclosure 12 of the first auxiliary switching unit Ba1.

According to an alternative embodiment that is not represented, the stop is rigid and of adjustable height. Indeed, as an example embodiment, the stop can comprise a threaded rod. The threaded rod is designed to collaborate with a tapped area positioned on the flange-plate or on the outer wall of the enclosure 12 of said switching unit.

According to another alternative embodiment that is not represented, the stop comprises a deformable means such as in particular a spring.

The invention claimed is:

1. A switchgear device comprising:

a single-pole main switching unit supporting an operating mechanism, and a first single-pole auxiliary switching unit, said units being arranged side-by-side in a transverse direction and each, respectively, comprising:

a rotary bar mounted in a mobile contact bridge for rotation around an axis of rotation; which extends in said transverse direction;

a pair of stationary contacts of said mobile contact bridge, each of said stationary contacts being connected to a current input conductor, the operating mechanism of the switching units comprising a handle for moving a drive rod that passes through the rotary bars, whereby an angular movement of the entire length of said drive rod drives the rotary bar of the mobile contact bridge between an open position and a closed position of the contacts, and compensation means comprising a stop against which the drive rod presses in the closed position for:

locally limiting movement of the drive rod at a level of the first auxiliary unit, and applying a rotational torque to the drive rod to keep it parallel to said axis of rotation.

2. The switchgear device according to claim 1, wherein said at least first auxiliary switching unit comprises an enclosure having an aperture therein in the form of an arc of the cylindrical path in which the drive rod moves between the closed and open positions, the stop being positioned for reducing the length of the arc of the cylindrical path and the angular movement of said drive rod in said aperture.

3. The switchgear device according to claim 2, wherein the stop is positioned in the first single-pole switching unit at one end of the arc of the cylindrical path forming the aperture for reducing the travel distance of the drive rod moving inside the aperture.

4. The switchgear device according to claim 2, wherein the switchgear device comprises a flange-plate positioned against an outer wall of the enclosure of the first single-pole switching unit, and the stop is positioned on said external flange plate.

5. The switchgear device according to claim 1, comprising three single-pole auxiliary switching units arranged side-by-side in a transverse direction, the first auxiliary switching unit being separated from the other two auxiliary switching units by the main switching unit supporting the operating mechanism of said units.

6. The switchgear device according to claim 1, wherein the stop is rigid and of adjustable height.

7. The switchgear device according to claim 1, wherein the stop comprises a deformable means.

8. The switchgear device according to claim 6, wherein the stop comprises a spring.

* * * * *